United States Patent [19]

Matthews

[11] 3,970,864

[45] July 20, 1976

[54] CONTROL ARRANGEMENT FAIL-SAFE TIMING CIRCUIT

[75] Inventor: Russell B. Matthews, Goshen, Ind.

[73] Assignee: Johnson Service Company, Milwaukee, Wis.

[22] Filed: Mar. 1, 1974

[21] Appl. No.: 447,165

[52] U.S. Cl. ..... 307/141

[51] Int. Cl.[2] ..... H01H 7/00

[58] Field of Search ..... 431/78, 79, 25; 328/6; 340/228.1; 307/141, 141.4, 141.8

[56] References Cited

UNITED STATES PATENTS

| | | | |
|---|---|---|---|
| 3,270,799 | 9/1966 | Pinckaers | 431/25 |
| 3,291,183 | 12/1966 | Fairley | 431/78 |
| 3,441,356 | 4/1969 | Walbridge | 431/66 |
| 3,649,156 | 3/1972 | Conner | 431/78 |
| 3,726,630 | 4/1973 | Potts | 431/78 |
| 3,770,364 | 11/1973 | Walbridge | 431/78 |
| 3,832,123 | 8/1974 | Walbridge | 431/78 |

*Primary Examiner*—David Smith, Jr.
*Attorney, Agent, or Firm*—Johnson, Dienner, Emrich & Wagner

[57] ABSTRACT

A fail-safe timing circuit energizable in response to a starting signal for activating a system, such as a fuel ignition system or an air conditioning system, includes a first switching circuit responsive to the request signal to activate the system to commence its operation tentatively, a time-out circuit responsive to the starting signal for generating a time-out signal after a predetermined time delay interval, a circuit responsive to a system variable such as the establishment of a flame in a fuel ignition system or the sufficient increase in oil pressure of a compressor in an air conditioning system becoming a predetermined condition, such as the flame occurring or the compressor oil pressure achieving a given desired value, for preventing the time-out circuit from generating its time-out signal, and a second switching circuit for causing the first switching circuit to de-activate the system in response to the time-out signal. As a result, the system is prevented from operating in an undesirable or unwanted manner should the system variable not reach the predetermined condition within the timing interval.

11 Claims, 3 Drawing Figures

CONTROL ARRANGEMENT FAIL-SAFE TIMING CIRCUIT

BACKGROUND OF THE INVENTION

1. Field of the Invention

The present invention relates to a control arrangement fail-safe timing circuit, and it more particularly relates to an automatic electronic fail-safe timing circuit for controlling the activation of a system, such as a fuel ignition system or an air conditioning system.

2. Description of the Prior Art

Control arrangements for system, such as fuel ignition and air conditioning systems, have been employed to selectively activate and de-activate the systems. For example, in a fuel ignition system control arrangement, ignition circuits have been employed to establish directly a flame in main burner apparatus of the system in response to a thermostatically-controlled switch generating a starting signal for activating the ignition circuit and for turning on a valve to permit gaseous fuel under pressure to be supplied to the burner apparatus. The arrangement would attempt to ignite the main burner apparatus, and if the resulting flame were not subsequently established due to a malfunction or any other reason, unburned gas would thereby escape unnecessarily and cause fuel to be wasted. Similarly, in air conditioning system, control arrangements have been provided to initiate automatically the operation of a compressor for the system. However, if the oil pressure of the compressor does not increase to an acceptable level in a reasonable period of time, it is desirable to de-activate the compressor unit and restart it subsequently. Therefore, it would be highly desirable to have a control arrangement fail-safe timing circuit, which would prevent undesirable and unwanted conditions of the system from occurring, such conditions as the escaping of unburned gas in a wasteful manner from the main burner apparatus of a fuel ignition system and as the causing of the operation of an air conditioning compressor without sufficient oil pressure.

SUMMARY OF THE INVENTION

Therefore, it is the principal object of the present invention to provide a new and improved control arrangement fail-safe timing circuit, which prevents certain conditions from occurring, such conditions as unwanted or undesirable conditions in air conditioning and fuel ignition systems.

The present invention provides a fail-safe timing circuit including a first switching circuit responsive to a request signal to activate the system to commence its operation tentatively, a time-out circuit responsive to the request signal for generating a time-out signal after a predetermined time delay interval, a circuit responsive to a system variable becoming a predetermined condition for preventing the timing circuit from generating its time-out signal, and a second switching circuit for causing the first switching circuit to de-activate the system in response to the time-out signal. Other features relate to the resetting of the timing circuit.

DESCRIPTION OF A PREFERRED EMBODIMENT

Figure 1:
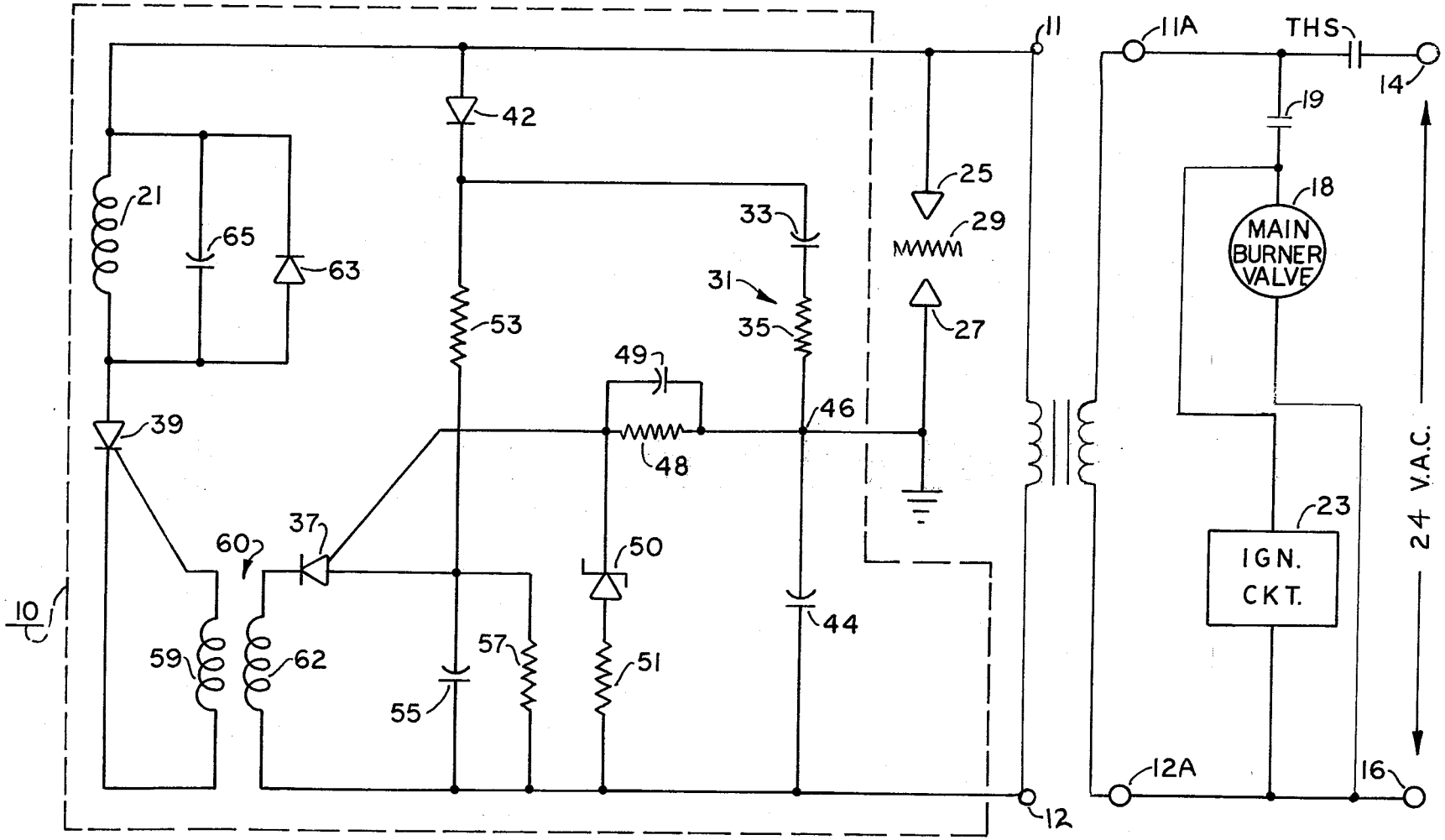
FIG. 1 is a schematic circuit diagram of a control arrangement fail-safe timing circuit for fuel ignition systems in accordance with the present invention.

Referring now to the drawings, and more particularly to FIG. 1 thereof, there is shown a fail-safe timing circuit 10 which is constructed in accordance with the present invention. The fail-safe timing circuit 10, which may be employed in a fuel ignition system, includes a pair of input terminals 11A and 12A connected to a pair of terminals 14 and 16 connected in turn to a source (not shown) of 24 volt AC power, the input terminal 11A being connected through a thermostatically-controlled normally-open switch THS and the terminal 12A being connected directly to the terminal 16. A control valve 18 is operated by switching devices, including a relay 21 and a first controlled switching device, embodied as a silicon controlled rectifier 39, for supplying gaseous fuel under pressure to burner apparatus (not shown) of the fuel ignition system. The control valve 18 is connected between the input terminals 11A and 12A of the circuit 10 in series with a pair of normally-open contacts 19 of the relay 21 of the circuit 10 and an ignition circuit 23 for igniting directly the fuel supplied to the burner apparatus. With circuit 10 of the present invention, the main gas valve 18 and the ignition circuit 23 are energized for a short period of time of, for example, 5 to 15 seconds as limited by a predetermined time delay interval of the timing circuit 10, for the purpose of establishing a flame, and if such a flame does not become established within the predetermined time delay interval of somewhere between 5 to 15 seconds, the main burner valve 18 is de-activated. Such a direct ignition heating system requires that any type of component failure that may occur must be fail safe, that is, the gas supply and ignition circuit must be shut off.

Briefly, in operation, when the thermostatically-controlled contacts THS close to request heat, power is connected across the terminals 11A and 12A and a second controlled switching device, embodied as a programmable unijunction transistor 37, is controlled by first and second charge retaining devices, embodied as respective capacitors 55 and 44, to provide pulses for enabling the silicon controlled rectifier 39. Accordingly, relay 21 is operated to close the relay contacts 19, whereby the main burner valve 18 and the ignition circuit 23 are energized in parallel through the contacts THS by the source of power connected across the terminals 14 and 16. As a result, gaseous fuel is supplied under control of the main burner valve 18 to the main burner apparatus and simultaneously therewith the ignition circuit 23 generates sparks for igniting the gaseous fuel supplied to the burner apparatus. A pair of spaced-apart electrodes 25 and 27 are disposed in close proximity to the burner apparatus and once a flame is established therebetween, the fail-safe timing circuit 10 maintains the relay 21 operated so that the main burner valve 18 remains open to supply gaseous fuel to the burner apparatus, it being understood that the ignition circuit 23 being de-energizable upon the establishment of a flame 29 in the burner apparatus. A time-out circuit 31 including a third charge retaining device, embodied as a capacitor 33, and a resistor 35 of the circuit 10 responds to the starting signal from the thermostatically-controlled switch THS for generating a time-out signal after a predetermined time delay interval. If the predetermined time delay interval expires before the flame 29 is established between the electrodes 25 and 27, the programmable unijunction transistor 37 stops conduction to cause a silicon-controlled rectifier 39 to be rendered non-conductive for the purpose of opening the circuit to the relay 21, whereby the contacts 19 open and thus the main burner valve 18 is de-energized to prevent unburned gaseous fuel from unnecessarily and unwantedly escaping.

Considering now the fail-safe timing circuit 10 in greater detail, a suitably-poled diode 42 is connected through the time-out circuit 31 comprising the series-connected capacitor 33 and the resistor 35 to the capacitor 44 which in turn is connected to the terminal 12. A point 46 between the resistor 35 and the capacitor 44 is connected through a current-limiting resistor 48 and a parallel-connected capacitor 49 to the gate of the PUT transistor 37 for control purposes. In order to control the anode of the PUT transistor 37, a resistor 53 connects the diode 42 to the anode of the PUT transistor 37, and a capacitor 55 and a parallel-connected discharge resistor 57 are connected between the anode of the PUT transistor 37 and the terminal 12. As a result, when 120 volt AC power is connected from the power terminals 14 and 16 via the thermostatically-controlled switch THS when closed to request the operation of the system, current flows through a path including the diode 42, the capacitor 33, the resistor 35, the capacitor 44 and the terminal 12 to cause the capacitor 44 to charge to a voltage whose value determines the charge on the capacitor 55 as hereinafter described in greater detail. The PUT unijunction transistor 37 conducts whenever the anode voltage exceeds the gate voltage by approximately 0.6 volts in the preferred embodiment of the present invention. Therefore, due to the conduction of the transistor 37, the voltage on the capacitor 55 is equal to the voltage on the capacitor 44 plus 0.6 volts. The capacitor 44 charges substantially instantaneously to the line voltage so that the voltage at the point 46 is at the voltage of the power source and so that the voltage of the power source is then applied to the gate of the PUT transistor 37. The anode of the PUT transistor 37 is at a lower voltage, and thus it does not conduct for approximately 4 seconds, which serves as an initial start-up predetermined time delay interval. This time-delay interval serves as a pre-purge period that allows the power vent of the heating system to start air flowing before the main gas valve 18 is opened. During the initial start-up time delay interval, the voltage on the time-out capacitor 33 increases and the voltage on the capacitor 44 decreases until the gate of the PUT transistor 37 has a voltage level which is less than the voltage on the anode of the PUT transistor 37 by approximately 0.6 volts, whereby it then conducts. The transistor 37 conducts until the capacitor 33 is completely charged in a time-out predetermined time delay interval, which in the preferred form of the present invention is about a 15 to 30 second time delay interval. If the flame 29 does not become established between the electrodes 25 and 27 connected between the terminal 11 and ground potential at the point 46 before the end of the time-out interval, the PUT transistor 37 is rendered non-conductive to cause the relay 21 to become de-energized for turning off the main burner valve 18 and the ignition circuit 23 as hereinafter described in greater detail. After the time-out delay interval determined by the capacitor 33 and the resistor 35 of the timing circuit 31, current flow into the capacitor 44 ceases when the time-out circuit capacitor 33 becomes fully charged. If the start-up sequence was successful, the flame 29 becomes established between the terminals 25 and 27 to provide a high impedance, rectified circuit to maintain a charge on the capacitor 44 so that the relay 21 remains energized as hereinafter described in greater detail.

In accordance with the present invention, in order to reset the timing circuit 10 for the full timing interval after a 5 second off time, when the power is removed from the circuit 10 by the opening of the thermostatically-controlled switch THS, the capacitor 33 discharges through the resistor 53, the anode of the PUT transistor 37 to the gate of the PUT transistor 77 through the resistors 48 and 35 back to the capacitor 33. The RC product of this discharge circuit determines the reset time interval.

During a successful ignition capacitor 33 also discharges via resistor 53, anode to gate of transistor 37 so that in case of a flame failure the full timing interval is available to attempt a reignition.

Considering now the operation of the relay 21 in greater detail, the relay coil 21 is connected at one of its ends to the terminal 11 and is connected at its other end through a silicon-controlled rectifier 39 to a pulse transformer 60, the output winding 59 being connected between the cathode of the SCR 39 and its gate, and the input winding 62 of the transformer 60 being connected between the cathode of the PUT transistor 37 and the terminal 12. The transistor 37, when so biased, conducts during positive half cycles of the AC power signal due to the rectification of the diode 42 to enable the capacitor to discharge through the transistor 37 to the primary winding 62, whereby the transistor 37 and the diode 42 serve to produce a series of pulses to supply them to the transformer 60, which in turn causes the SCR 39 to conduct during these pulses. A suitably-poled diode 63 and a capacitor 65 are each connected in parallel with the relay coil 21 to render it slow-to-release, whereby after the initial start-up time delay interval, the PUT transistor 37 and the SCR 39 are rendered conductive during positive half cycles of the AC power signal to cause the relay 21 to become operated. The SCR will remain conducting for the portion of the positive half cycle remaining after the turn on pulse from transistor 37. This is an inherent property of the SCR. The capacitor 65 and the diode 63 provide a predetermined time delay interval which is substantially longer than the interval of time between the pulses and thereby maintain the field in the relay coil during the non-conducting portion of the cycle.

TIMING CIRCUIT 10 OPERATION

Considering now the operation of the circuit 10, when the thermostatically-controlled switch THS generates a request signal by closing the circuit from the power terminals 14 and 16 to the input terminals 11A and 12A of the circuit 10, current flows through a path including the diode 42, the capacitor 33, the resistor 35, and the capacitor 44 to the terminal 12, and current also flows through the diode 42, the resistor 53, to charge the capacitor 55 as determined by the value of the resistor 53. During the initial four second start-up time delay interval, the capacitor 33 charges toward the potential of the 120 volt AC power source, and the capacitor 44 having charged substantially instantaneously to that voltage of 120 volts now discharges until the voltage on the gate of the PUT transistor 37 is less than the voltage on the anode of the PUT transistor 37 by approximately 0.6 volts. The discharging of the capacitor 44 requires about 4 seconds in the preferred form of the present invention, whereupon the PUT transistor 37 conducts and then the capacitor 55 discharges through the anode-cathode circuit of the PUT transistor 37 to cause a voltage spike to be applied to the input winding 62 of the transformer 60. Thus, a pulse is induced in the output winding 59 of the transformer 60 to cause the SCR 39 to conduct, whereby the relay 21 operates in series with the relay 39 to close its contacts 19 for initiating the operation of the system tentatively. During the same positive half cycle of the power, the capacitor 55 continues to discharge through the PUT transistor 37 until the voltage on the capacitor 55 and thus the anode of the PUT transistor 37 is substantially equal to the voltage on the gate of the PUT transistor 37 as determined by the voltage on the capacitor 44, at which time the PUT transistor 37 is rendered non-conductive. The SCR 39 remains in conduction for the remaining portion of the positive half of the sine wave and the relay 21 remains operated due to the diode 63 and the capacitor 65. During the next positive half cycle of the power signal, the capacitor 55 charges until the voltage on the anode of the PUT transistor 37 is approximately equal to 0.6 volts greater than the voltage at the gate of the PUT transistor 37 for causing it to be driven into conduction and thus turn on the SCR 39 to maintain the relay 21 energized. Thus, the PUT transistor 37 and the SCR 39 are both alternately turned on and off following the initial start-up four second timing interval.

During the time-out time delay interval when the relay 21 is operated, its contacts 19 are closed to cause the main burner valve 18 and the ignition circuit 23 to be energized, whereby the ignition circuit 23 attempts to establish a flame in the main burner apparatus (not shown). Should such a flame not be established within the time-out timing interval, the capacitor 44 becomes fully discharged and the capacitor 33 charges to the 120 volt level of the power signal. As a result, no further current flows into the capacitor 44 and the PUT transistor 37 can no longer be rendered conductive. As a result, the relay 21 becomes eventually de-energized, since the SCR 39 remains non-conductive. When the relay 21 restores, it opens its contacts 19 to de-energize the ignition circuit 23 and the main burner valve 18 to cut off further gaseous fuel to be supplied to the main burner apparatus.

If the flame 29 is established before the end of the time-out interval, a high impedance path is completed between the electrodes 25 and 27 through the flame 29 to short-circuit substantially the diode 42, the capacitor 33, and the resistor 35, whereby the capacitor 44 is permitted to maintain a charge thereon so that the PUT transistor 37 continues to be rendered conductive during positive half cycles of the power signal to cause the SCR 39 to also be rendered conductive during such half cycles for the purpose of maintaining the relay 21 energized. In this regard, once the flame 29 is established between the electrodes 25 and 27 to effectively short-circuit the capacitor 33, the capacitor 44 does not discharge as rapidly as before, and therefore the anode voltage of the transistor 37 remains at a higher level than the gate potential for the transistor 37.

In one exemplary embodiment, the components of the electronic timing circuit 10 may have the values listed in Table I.

| | |
|---|---|
| Capacitor 33 | 0.47 Microfarads |
| Resistor 35 | 2.2K Ohms |
| Capacitor 44 | 1 Microfarad |
| PUT 37 | 2N6027 |
| Resistor 48 | 2.2 Megohms |
| SCR 39 | C106B |
| Capacitor 49 | 470 Micro-microfarads |
| Resistor 51 | 4.7K Ohms |
| Resistor 53 | 27OK Ohms |
| Capacitor 55 | .47 Microfarads |
| Resistor 57 | 100K Ohms |
| Capacitor 65 | 22 Microfarads |

It is to be understood that the operating voltage range which establishes the relationship between the gate and anode voltages, both phase and magnitude, for the PUT transistor 37, is a matter of choice and that there are a large number of combinations of values for the various different resistors and capacitors of the circuit 10 to provide satisfactory operation of the circuit. Similarly, the various different diodes, the relay 21 and the pulse transformer 60 may be of various different suitable operating characteristics. It should be understood that in accordance with the present invention that the pulse transformer 60 provides necessary isolation in the gate circuit of the SCR 39 so that in the case of a failure of a circuit component, such as in the case where a single resistor were to replace the pulse transformer 60, such an open resistor would result in an unsafe circuit condition such as having the relay operated without a flame being established in the burner apparatus.

Figure 2:
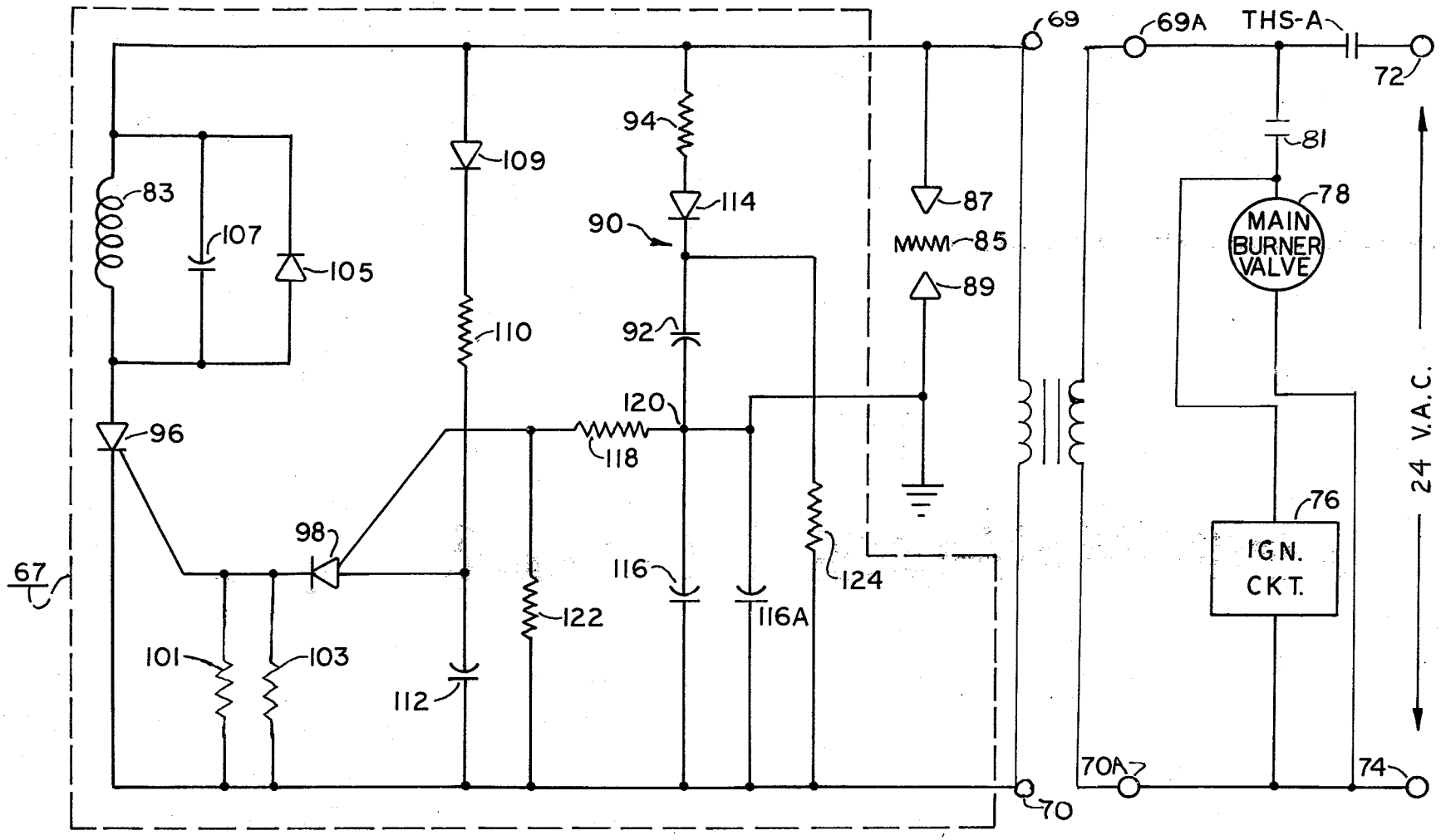
FIG. 2 is a schematic circuit diagram of another control arrangement fail-safe timing circuit for a fuel ignition system in accordance with the present invention.

Referring now to FIG. 2 of the drawings, there is shown a fail-safe timing circuit 67, which is similar to the circuit 10, and which is adapted to be employed in a fuel-ignition system (not shown). The fail-safe timing circuit 67, while being generally similar to the circuit 10, employs a slightly different reset arrangement and other differences which will become apparent in the hereinafter contained description. The fail-safe timing circiit 10 includes a pair of output terminals 69A and 70A connected to a pair of power terminals 72 and 74, which are in turn connected to a source (not shown) of 24 volt AC power, the output terminal 69A being connected through a thermostatically-controlled normally-open switch THS and the terminal 70A being connected directly to the terminal 74. An ignition circuit 76 is energized in parallel with a main burner valve 78 when the normally-open contacts 81 of a relay 83 of the circuit 67 are closed to connect the main burner valve 78 in parallel with the ignition circuit 76 to the power terminals 72 and 74 via the normally-open thermostatically-controlled switch THS-A between the main burner valve 78 and the terminal 72, whereby when the ignition circuit is energized, it generates sparks for igniting gaseous fuel flowing to the main burner apparatus (not shown) via the main burner valve 78. If a flame 85 is not established between a pair of spaced-apart electrodes 87 and 89 before the expiration of a predetermined time-out interval determined by a timing circuit 90, including the timing capacitor 92 and the resistor 94, the relay 83 becomes de-energized as hereinafter described in greater detail to de-activate in turn the main burner valve 78 and the ignition circuit 76 to prevent the unnecessary and wasteful escaping of gaseous fuel. In the event that the flame 85 is successfully established between the electrodes 87 and 89 during the time-out interval, the relay 83 is maintained operated as hereinafter described in greater detail.

Considering now the circuit 67 in greater detail with reference to FIG. 2 of the drawings, a silicon-controlled rectifier 96 has its cathode connected in series with the relay coil 83 and has its cathode connected to the terminal 70 of the circuit 67, the SCR 96 having its gate electrode connected to the cathode of a programmable unijunction transistor 98 with a pair of redundantly connected resistors 101 and 103 being connected between the gate of the SCR 96 and the terminal 70. The two redundant resistors 101 and 103 connected in parallel are provided in a duplicated fashion so that if one of the resistors malfunctions and open circuits, the circuit 10 continues to function and maintain the relay 83 operated so that the relay does not inadvertently remain operated without a flame to cause unburned gaseous fuel to be wasted. A suitably-poled diode 105 and a capacitor 107 are connected in parallel across the relay coil 83 to maintain the relay 83 operated during negative half cycles of the power signal when the SCR 96 and the PUT transistor 98 are non-conductive in a similar manner as the operation of the circuit 10. The anode of the PUT transistor 98 is controlled by a circuit connected between the terminals 69 and 70 and includes a suitably-poled diode 109 and a resistor 110 connected between the terminal 69 and the anode of the PUT transistor 98, a capacitor 112 being connected between the anode of the PUT transistor 98 and the terminal 70. The gate of the PUT transistor 98 is controlled by another circuit which extends between the terminals 69 and 70 and which includes the resistor 94, a suitably-poled diode 114, the capacitor 92 and a capacitor 116, all of which being connected between the terminals 69 and 70. In order to bias the gate of the PUT transistor 98, a current-limiting resistor 118 is connected between a point 120 between the capacitors 92 and 116 to the gate of the PUT transistor 98, a resistor 122 being connected between the gate of the PUT device 98 and the terminal 70. A resistor 124 has one of its ends connected between the diode 114 and the capacitor 92 and has its other end connected to the terminal 70 for providing a reset for the circuit 67. For redundancy purposes, a capacitor 116A is connected in parallel with the capacitor 116.

TIMING CIRCUIT 67 OPERATION

Considering now the operation of the circuit 67, when the normally-open thermostatically-controlled contacts THS-A close to generate a starting signal for the fuel ignition system, the voltage on the capacitor 92 increases toward the line voltage, and the voltage on the parallel redundant capacitors 116 and 116A decreases. The voltage on the capacitor 112 is increasing during this initial start-up period. At the end of the initial start-up period, which in the preferred form of the present invention is approximately four seconds, the voltage on the gate of the PUT transistor 98 falls below the voltage on the anode of the PUT device 98 to render it conductive during positive half cycles of the power line, the diodes 109 and 114 serving as half wave rectifiers. When the PUT transistor 98 conducts during the positive half cycles, the capacitor 112 discharges through the cathode-anode circuit of PUT device 98 to cause the SCR 96 to conduct, thereby causing the relay 83 to operate, so that the diode 105 and the capacitor 107 maintain the relay 83 operated during the negative half cycles of the power signal when the PUT transistor 98 and the SCR 96 are deenergized. After the initial start-up interval of time, there is provided a time-out interval controlled by the capacitor 92 of the timing circuit 90 of a duration which may be from 15 to 30 seconds depending on the desired application to enable the ignition circuit 76 to ignite the fuel supplied by the main burner valve 78 to the main burner apparatus. The ignition of the gaseous fuel is enabled once the relay 83 operates to close its contacts 81 for supplying power via the switch THS-A to the main burner valve 78 in parallel with the ignition circuit 76. Should the time-out interval expire before the flame 85 is established between the electrodes 97 and 89, the voltage on the redundant capacitors 116 and 116A decrease sufficiently and the voltage on the capacitor 92 reaches the line potential to become completely charged, whereby current discontinues flowing to the capacitor 116 and the capacitor 116A. As a result, the PUT transistor 98 stops conducting, and thus the SCR 96 is no longer rendered conductive so that the relay 83 eventually becomes de-energized. The contacts 81 of the relay 83 open to de-energize the main burner valve 78 and the ignition circuit 76 to prevent any wasting of unburned gaseous fuel.

Should the flame 85 be established between the electrodes 87 and 89 prior to the expiration of the time-out interval, a high impedance path between the electrodes 87 and 89 through the flame 85 effectively short-circuits the timing capacitor 92, the diode 114 and the resistor 94 so that in a similar manner as the circuit 10, the capacitors 116 and 116A are permitted to maintain a charge thereon so that the transistor 98 continues to be rendered conductive during positive half cycles of the power signal to cause the relay 83 to remain operated.

In one exemplary embodiment, the components of the circuit 67 may have the values listed in Table II.

| | |
|---|---|
| Capacitor 92 | 2.2 Microfarads |
| Resistor 94 | 220K Ohms |
| SCR 96 | C106-B |
| Transistor 98 | 2N6028 |
| Resistor 101 | 220 Ohms |
| Resistor 103 | 220 Ohms |
| Capacitor 107 | 22 Microfarads |
| Resistor 110 | 270K Ohms |
| Capacitor 112 | 0.47 Microfarads |
| Capacitor 116 | 0.047 Microfarads |
| Capacitor 116A | 0.047 Microfarads |
| Resistor 118 | 2.2 Megohms |
| Resistor 122 | 330K Ohms |
| Resistor 124 | 1 Megohm |

Figure 3:
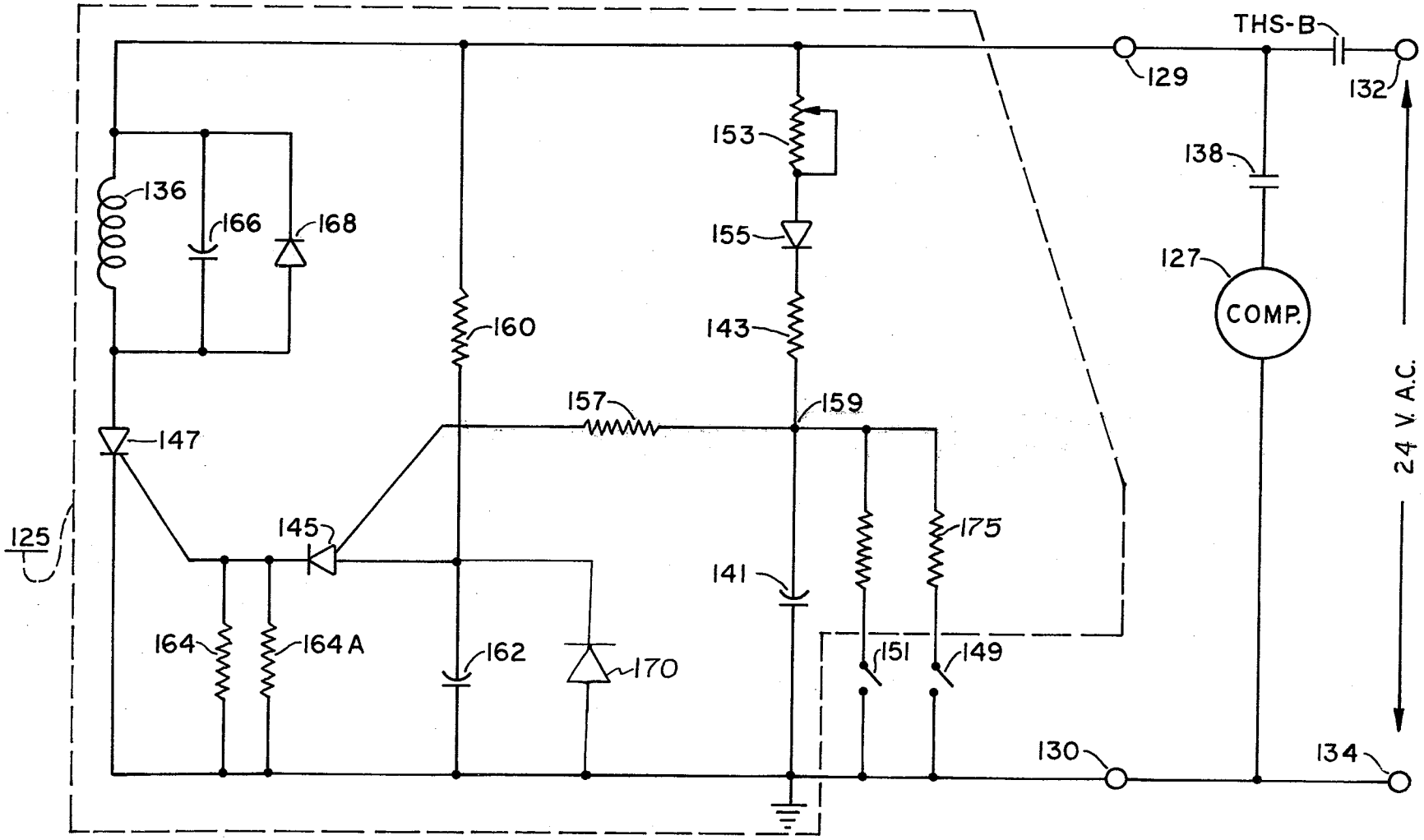
FIG. 3 is a schematic circuit diagram of a control arrangement fail-safe timing circuit for an air conditioning system in accordance with the present invention.

Referring now to FIG. 3 of the drawings, there is shown a fail-safe timing circuit 125 which is adapted to control the energization of a compressor 127 of an air conditioning system (not shown). The circuit 125 is utilized as an oil pressure protector circuit which prevents the air conditioner compressor 127 from operating if its differential oil pressure drops below a predetermined value. Also, the circuit 125 permits the compressor 127 to run for approximately 30 seconds before disabling it should its differential oil pressure drop below the predetermined value. Alternatively, if the oil pressure of the compressor 127 increases to an acceptable level within the predetermined time interval of 30 seconds, the circuit 125 as hereinafter described in greater detail allows the compressor 127 to continue to operate.

The circuit 125 includes a pair of input terminals 129 and 130 which are connected respectively through a normally-opened thermostatically-controlled switch THS-B to a power terminal 132 and directly to another power terminal 134, a source (not shown) of 24 AC power being connected across the power terminals 132 and 134 to activate the circuit 125. A relay 136 of the circuit 125 has a pair of normally-open contacts 138 connected between the terminal 129 and the compressor 127, which is connected between the contacts 138 and the power terminal 134 so that when the relay 136 is operated to close its contacts 138, the compressor 127 is activated when the thermostatically-controlled contacts THS-B are closed to request the operation of the air conditioning system. A time-out circuit 139, including a timing capacitor 141 connected in series with a resistor 143, generates a time-out signal at the end of a predetermined time-out delay interval to render non-conductive a programmable unijunction transistor 145 and a silicon-controlled rectifier 147 to cause the relay 136 to be de-energized, whereby the contacts 138 open to de-activate the compressor 127. A pair of normally-opened differential oil pressure switch contacts 149 close when the differential oil pressure of the compressor 127 exceeds a predetermined value to maintain the PUT device 145 and the SCR 147 conductive so that the relay 136 remains operated to cause the compressor 127 to remain operative. A normally-open manually operable switch 151 serves as a reset switch for the circuit 125 by enabling the timing capacitor 141 to be discharged manually as hereinafter described in greater detail.

Considering now the circuit 125 in greater detail, a variable resistor 153 is connected between the input terminal 129 and a suitably-poled diode 155 which serves as a half-wave rectifier for the PUT transistor 145, and which is connected through a current-limiting resistor 143 and the timing capacitor 141 to the grounded terminal 130. A resistor 157 is connected between the gate of the PUT transistor 145 and a point 159 between the resistor 143 and the capacitor 141 to bias the gate of the transistor 145 depending upon the potential on the capacitor 141 as hereinafter described in greater detail. A resistor 160 is connected between the terminal 129 and the anode of the transistor 145, a capacitor 162 being connected between the anode of the transistor 145 to the grounded terminal 130 to bias the transistor 145 relative to the bias provided by the capacitor 141. A pair of redundant resistors 164 and 164A are connected in parallel between the gate of the SCR 147 and the grounded terminal 130, the gate of the SCR 147 being connected also directly to the cathode of the transistor 145. A capacitor 166 is connected in parallel with a suitably poled diode 168, and the pair of the capacitor 166 and the diode 168 are connected across the relay 136 to render it slow to release for the purpose of maintaining it operative during negative half cycles when the transistor 145 and the SCR 147 are rendered non-conductive as a result of the half-wave rectifying diode 155.

TIMING CIRCUIT 125 OPERATION

Considering now the operation of the circuit 125, assuming that the thermostatically-controlled switch THS-B generates a request signal by closing the circuit from the power terminals 132 and 134 to the input terminals 129 and 130, current flows through a path including the variable resistor 153, the diode 155, the resistor 143 and the capacitor 141 to the grounded terminal 130. Current also flows from the terminal 129 through the path, including the resistor 160, and the capacitor 162, to the grounded terminal 130. As mentioned in connection with the circuits 10 and 67, the voltage on the capacitor 141 determines the charge on the capacitor 162 in that the voltage on the capacitor 141 plus a +0.6 volts equals the voltage on the capacitor 30 due to the conduction of the PUT transistor 145. Thus, during each positive half cycle of the power signal, the capacitor 162 charges at a faster rate than the capacitor 141 so that eventually the voltage on the anode of the transistor 145 is greater than the voltage at the gate by approximately 0.6 volts, whereby the transistor 145 conducts to enable the capacitor 162 to discharge through the redundant resistors 164 and 164A. As a result, the SCR 147 conducts to cause the relay 136 to operate. The relay 136 operates and closes its contacts 138 for enabling the compressor 127 to be activated tentatively. During the next negative portion of the power signal, the diode 155 blocks the capacitor 141, and the capacitor 162 is by-passed by diode 170 during the negative portion of the sine wave. During the next positive half cycle, the operation is repeated to generate another pulse to operate the SCR 147 to maintain the relay 136 operated as explained in connection with the circuits 10 and 67. If the differential oil pressure switch 149 does not close within a predetermined time delay interval of approximately 30 seconds, the voltage on capacitor 141 and the gate of the PUT device 145 exceeds the anode voltage to cause the PUT device 145 to discontinue conducting during both half cycles of the power signal. As a result, the SCR 147 similarly ceases its conduction so that the relay subsequently restores to turn off the compressor. If the oil pressure rises to an acceptable level and the contacts 149 close, the voltage on the capacitor 141, instead of charging to the line voltage, is held to a reduced value determined by the voltage divider network of resistors 153, 143 and 175 divided by resistor 175 and prevents the gate voltage on the PUT device 145 from exceeding the voltage on the anode, whereby the SCR 147 continues to conduct to maintain the relay 136 operated.

The following Table III is a list of component values which may be used for the circuit 125:

Table III

| | |
|---|---|
| Capacitor 141 | 10 Microfarads |
| Resistor 143 | 2.7 Meg ohms |
| PUT 145 | 2N6028 |
| SCR 147 | C106B |
| Resistor 153 | 1 Meg ohm |
| Resistor 157 | 2.2 Meg ohms |
| Resistor 160 | 12K Ohms |
| Capacitor 162 | 0.47 Microfarads |
| Resistors 164, 164A | 220 Ohms |
| Capacitor 166 | 22 Microfarads |
| Resistor 175 | 2.2 Meg ohms |

I claim:

1. In a control arrangement for activating a system, a fail-safe timing circuit energizable in response to a request signal, said fail-safe timing circuit comprising first switching means operable when enabled to activate the system to commence its operation tentatively, second switching means operable when enabled to enable said first switching means, first timing means including first charge retaining means responsive to said request signal for charging toward a given potential to provide an increasing potential at a first control input of said second switching means, and second charge retaining means responsive to said request signal for discharging from said given potential to provide a decreasing potential at a second control input of said second switching means, said second switching means being enabled when the potential at said second control input decreases to a value which is a predetermined amount less than the potential at said first control input to enable said first switching means, second timing means responsive to said request signal for generating a time-out signal after a predetermined time delay interval for inhibiting said first timing means whereby said first and second switching means are disabled to de-activate the system, and circuit means responsive to a system variable becoming a predetermined condition for preventing said second timing means from generating its time-out signal.

2. A fail-safe timing circuit according to claim 1, further including discharge circuit means for resetting said second timing means responsive to the absence of said request signal.

3. A fail-safe timing circuit according to claim 2, wherein said second timing means includes a capacitor and a capacitor-charging resistance means, said discharge circuit means including a discharge resistance path coupled to said capacitor.

4. In a control arrangement for activating a system, a fail-safe timing circuit energizable in response to a request signal, said fail-safe timing circuit comprising first switching means operable when enabled to activate the system to commence its operation tentatively, second switching means operable when enabled to enable said first switching means, first charge retaining means responsive to said request signal for charging toward a given potential to provide an increasing potential at a first control input of said second switching means, second charge retaining means responsive to said request signal for discharging from said given potential to provide a decreasing potential at a second control input of said second switching means, said second switching means being enabled when the potential at said second control input decreases to a value which is a predetermined amount less than the potential at said first control input to enable said first switching means, third charge retaining means responsive to said request signal for charging toward said given potential for controlling the discharging of said third charge retaining means to prevent the potential at said second control input from reaching said predetermined value to thereby cause said second switching means to disable said first switching means to de-activate the system, and variable sensing means responsive to a system variable assuming a predetermined condition for preventing said third charge retaining means from causing the system from becoming deactivated.

5. A fail-safe timing circuit according to claim 4, wherein said second switching means includes pulse means for producing a series of pulses to cause said first switching means to become operative during each pulse and for permitting said first switching means to become inoperative alternately in the absence of said pulses, said pulse means including delay means for maintaining the system operative for a predetermined time delay interval, said interval being substantially greater than the interval of time between said pulses.

6. A fail-safe timing circuit according to claim 5, wherein said pulse means includes a rectifying means for converting alternating current signals to half wave rectified signals for producing said pulses.

7. A fail-safe timing circuit according to claim 6, wherein said first switching means includes a first bi-stable device for controlling said system and a second bi-stable device for controlling said first bi-stable device in response to said pulses.

8. A fail-safe timing circuit according to claim 7, wherein said first bi-stable device comprises a relay.

9. A fail-safe timing circuit according to claim 7, wherein said second bi-stable device comprises a silicon controlled rectifier.

10. In a control arrangement for activating a system, a fail-safe timing circuit energizable in response to a request signal, said fail-safe timing circuit comprising switching means operable when enabled to activate the system to commence its operation, a controlled switching device operable when enabled for enabling said switching means, first timing means including a first capacitor means responsive to said request signal for charging toward a given potential to provide an increasing potential at a first control input of said controlled switching device, and a second capacitor means responsive to said request signal for discharging from said given potential to provide a decreasing potential at a second control input of said controlled switching device, said controlled switching device being enabled when the potential at said second control input decreases to a value which is a predetermined amount less than the potential at said first control electrode to enable said switching means, second timing means for inhibiting said first timing means after a predetermined time interval following the occurrence of said request signal to cause said controlled switching device to disable said switching means to de-activate the system, and circuit means responsive to a system variable becoming a predetermined condition for preventing said second timing means from inhibiting said first timing means.

11. In a control arrangement for activating a system, a fail-safe timing circuit energizable in response to a request signal, said fail-safe timing circuit comprising switching means operable when enabled to activate the system to commence its operation, a controlled switching device having a first control input, a second control input, and an output connected to an enabling input for said switching means, first capacitor means connected to said first control input and responsive to said request signal for charging toward a given potential to provide an increasing potential at said first control input, second capacitor means connected to said second control input and responsive to said request signal for discharging from said given potential to provide a decreasing potential at said second control input, said controlled switching device being enabled when the potential at said second control input decreases to a value which is a predetermined amount less than the potential at said first control input to enable said switching means to activate the system, third capacitor means responsive to said request signal for charging toward said given potential for controlling the discharging of said second capacitor means to prevent the potential at said second control input from reaching said predetermined value to thereby cause said controlled switching device to disable said switching means to de-activate the system, and sensing means responsive to a system variable assuming a predetermined condition for preventing said third capacitor means from causing the system to be deactivated.

* * * * *